US011793704B2

(12) United States Patent
Kuroda et al.

(10) Patent No.: US 11,793,704 B2
(45) Date of Patent: Oct. 24, 2023

(54) ASSISTING DEVICE CONTROL SYSTEM AND DRIVING PERMISSION RANGE DECIDING METHOD

(71) Applicant: Honda Motor Co., Ltd., Tokyo (JP)

(72) Inventors: Kazunori Kuroda, Saitama (JP); Hiroyuki Tsuruoka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 400 days.

(21) Appl. No.: 16/986,285

(22) Filed: Aug. 6, 2020

(65) Prior Publication Data

US 2021/0038462 A1 Feb. 11, 2021

(30) Foreign Application Priority Data

Aug. 9, 2019 (JP) ..... 2019-147039

(51) Int. Cl.

| | |
|---|---|
| ***A61H 3/00*** | (2006.01) |
| ***G08B 21/18*** | (2006.01) |
| ***A61H 1/02*** | (2006.01) |

(52) U.S. Cl.

CPC ..... *A61H 3/00* (2013.01); *A61H 1/024* (2013.01); *A61H 1/0244* (2013.01); *G08B 21/182* (2013.01); *A61H 2201/165* (2013.01); *A61H 2201/501* (2013.01); *A61H 2201/5061* (2013.01); *A61H 2201/5097* (2013.01)

(58) Field of Classification Search

CPC ..... A61H 3/00; A61H 1/024; A61H 1/0244; A61H 2201/165; A61H 2201/501; A61H 2201/5061; A61H 2201/5097; G08B 21/182

See application file for complete search history.

(56) References Cited

U.S. PATENT DOCUMENTS

| | | | | |
|---|---|---|---|---|
| 10,792,213 | B2 * | 10/2020 | Murakami | A61H 1/02 |
| 2017/0202724 | A1 * | 7/2017 | De Rossi | A61F 5/0102 |
| 2018/0092793 | A1 * | 4/2018 | Murakami | A61H 1/0262 |
| 2018/0296426 | A1 * | 10/2018 | Kappel | A61H 3/02 |
| 2019/0110943 | A1 * | 4/2019 | Murakami | A61B 5/6812 |
| 2020/0268592 | A1 * | 8/2020 | Johnson | A61H 1/006 |
| 2020/0312118 | A1 * | 10/2020 | Compton | G08B 31/00 |

FOREIGN PATENT DOCUMENTS

| | | |
|---|---|---|
| JP | 2016022383 | 2/2016 |

* cited by examiner

*Primary Examiner* — Jerrah Edwards
*Assistant Examiner* — Aren Patel
(74) *Attorney, Agent, or Firm* — JCIPRNET

(57) ABSTRACT

The disclosure provides an assisting device control system capable of appropriately fixing a brace to the body of a wearer. A control system S includes: a waist sensor 10*f*, a right leg sensor 14*f*, and a left leg sensor 14*g* detecting a tension factor when a brace is worn; a tension recognition part 25 recognizing a tension from the tension factor; and a driving control part 26 controlling the driving of an assisting device 1. The driving control part 26 permits the driving of the assisting device 1 if the recognized tension is within a permission range, which has a predetermined lower limit value and a predetermined upper limit value.

20 Claims, 10 Drawing Sheets

ASSISTING DEVICE CONTROL SYSTEM AND DRIVING PERMISSION RANGE DECIDING METHOD

CROSS-REFERENCE TO RELATED APPLICATION

This application claims the priority benefits of Japanese application no. 2019-147039, filed on Aug. 9, 2019. The entirety of the above-mentioned patent application is hereby incorporated by reference herein and made a part of this specification.

BACKGROUND

Technical Field

The disclosure relates to an assisting device control system for controlling an assisting device that applies an assisting force corresponding to movement of a wearer to the body of the wearer, and relates to a driving permission range deciding method for deciding a permission range of tension in which driving of the assisting device is permitted.

Description of Related Art

There is a conventional assisting device, which applies an assisting force to the legs, etc. of the wearer for assisting the joints of the wearer to move, in order to assist movement of the wearer such as walking and bending. This type of assisting device may be provided with a sensor for detecting whether a brace is in a fixed state with respect to the body of the wearer, and apply the assisting force only when it is determined that the brace is in the fixed state (for example, see Patent Document 1).

RELATED ART

Patent Document

[Patent Document 1] Japanese Laid-Open No. 2016-22383

PROBLEMS TO BE SOLVED

However, the assisting device of Patent Document 1 only determines whether the brace is in the fixed state with respect to the body of the wearer. Therefore, if the brace can be fixed, the assisting device will start to apply the assisting force regardless of whether the brace is fixed to the body of the wearer with an inappropriate force.

Then, for example, if the brace is fixed with an excessive force, the wearer may feel uncomfortable when the assisting force is applied to the wearer, or the assisting force applied may be inappropriate.

SUMMARY

An assisting device control system of the disclosure controls an assisting device, which includes a brace worn on a predetermined portion of a body of a wearer, and an assisting mechanism moving the brace to apply an assisting force corresponding to movement of the wearer to the body of the wearer. The assisting device control system includes: a sensor detecting a tension factor, which is a factor related to a tension when the brace is worn; a tension recognition part recognizing the tension from the detected tension factor; and a driving control part controlling driving of the assisting mechanism. The driving control part permits driving of the assisting mechanism if the recognized tension is within a permission range, which has a predetermined lower limit value and a predetermined upper limit value.

A driving permission range deciding method of the disclosure is for deciding a permission range in an assisting device control system, which controls an assisting device and includes: a tension recognition part recognizing a tension when a brace is worn on a predetermined portion of a body of a wearer; a driving control part permitting driving of an assisting mechanism, which moves the brace to apply an assisting force corresponding to movement of the wearer to the body of the wearer, if the recognized tension is within the permission range that has a predetermined lower limit value and a predetermined upper limit value; and a range deciding part deciding the permission range, wherein the assisting device includes the brace and the assisting mechanism. The assisting device control system includes a data storage part storing tensions recognized during previous uses of the assisting device or assisting equipment corresponding to the assisting device. The driving permission range deciding method includes: a step that the range deciding part decides a permission range for a current use based on the tensions recognized during the previous uses.

DESCRIPTION OF THE EMBODIMENTS

Figure 1:
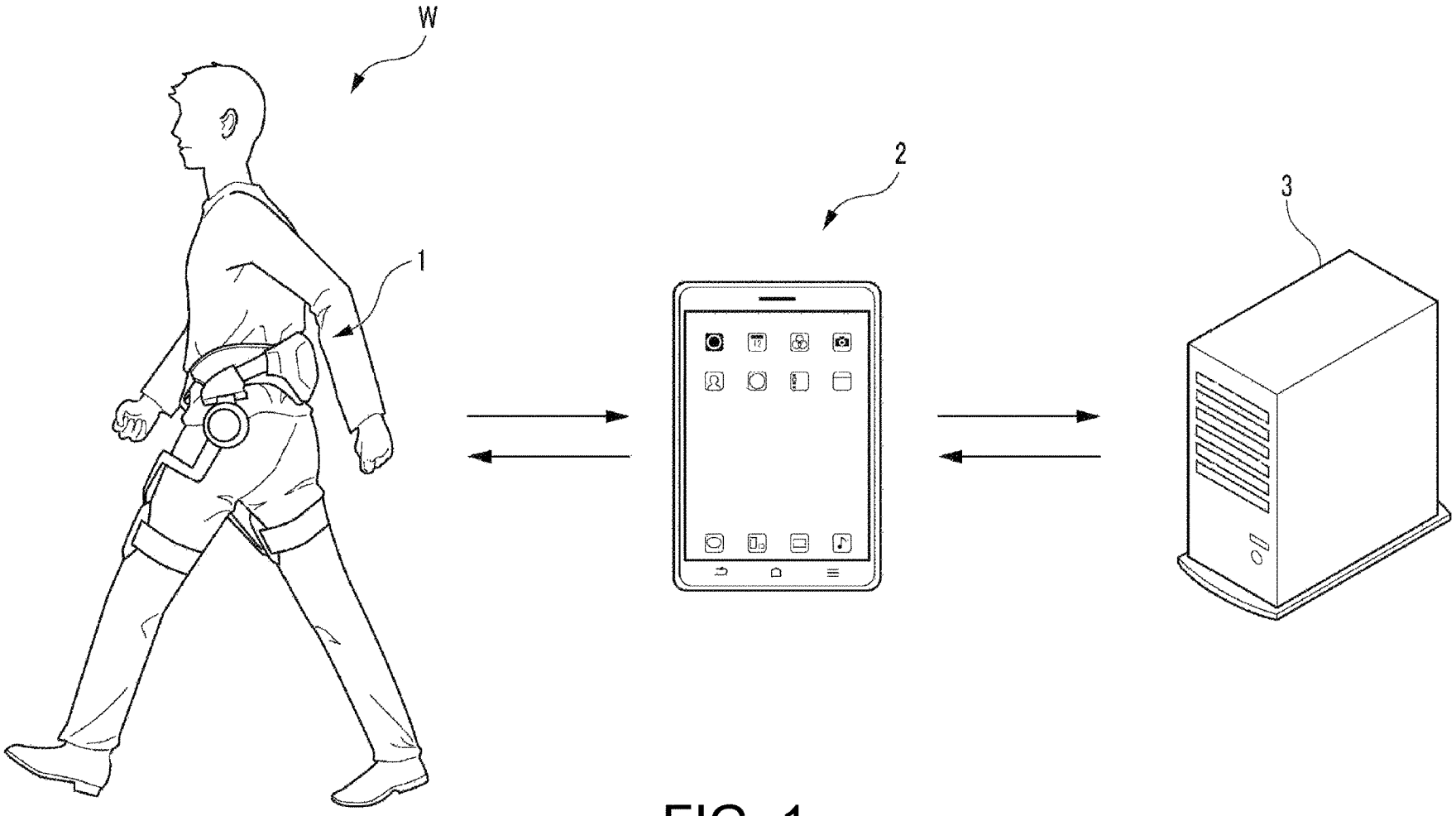
FIG. 1 is a schematic view showing a configuration of a control system according to an embodiment.

In view of the above, the disclosure provides an assisting device control system and a driving permission range deciding method capable of appropriately fixing a brace to the body of a wearer.

Means for Solving the Problems

An assisting device control system of the disclosure controls an assisting device, which includes a brace worn on a predetermined portion of a body of a wearer, and an assisting mechanism moving the brace to apply an assisting force corresponding to movement of the wearer to the body of the wearer. The assisting device control system includes: a sensor detecting a tension factor, which is a factor related to a tension when the brace is worn; a tension recognition part recognizing the tension from the detected tension factor; and a driving control part controlling driving of the assisting mechanism. The driving control part permits driving of the assisting mechanism if the recognized tension is within a permission range, which has a predetermined lower limit value and a predetermined upper limit value.

Here, the "tension factor" includes not only the tension itself when the brace is worn, but also a factor that can be used to estimate the tension. For example, the tension factor includes the stress applied to a frame for connecting the braces, the output of a driving source that generates a driving force for moving the braces, etc. Further, the tension when the wearer wears a brace worn on a first portion of the body may be used as a tension factor to estimate the tension when the wearer wears a brace worn on a second portion of the body.

There is a certain correspondence relationship between the tension applied to the brace when the brace is worn and the force for fixing the brace (that is, the fixed state). Then, the assisting device control system of the disclosure is configured to permit the driving of the assisting mechanism if the recognized tension is within the permission range which has the predetermined lower limit value and the predetermined upper limit value.

Therefore, in the assisting device control system, the driving of the assisting mechanism is not permitted not only when the tension is equal to or smaller than the predetermined lower limit value and the brace is not fixed to the body of the wearer, but also when the tension is equal to or greater than the predetermined upper limit value and the brace is fixed with an excessive force.

Thus, according to the assisting device control system, the assisting force is applied to the wearer only when the brace is fixed with an appropriate force. As a result, with the assisting device controlled by the assisting device control system, it is possible to prevent the wearer from feeling uncomfortable and prevent an inappropriate assisting force from being applied when the assisting force is applied.

In addition, the assisting device control system of the disclosure may include a detection instruction part transmitting a signal instructing the sensor to detect the tension factor according to a detection request.

Here, the "detection request" is a signal caused by an operation of the wearer and a person who enables the wearer to use the assisting device (hereinafter referred to as "wearer, etc."), and refers to a signal for instructing to detect the tension factor. Specifically, for example, the detection request is a signal generated when a detection switch provided in the assisting device is pressed, a signal based on a detection command input via a tablet, etc. that controls the assisting device, etc.

The tension of the brace is not always constant, and varies depending on the posture of the wearer and the movement after the brace is worn. By providing such a detection instruction part, it is possible to detect the tension factor for estimating the tension at any timing. Therefore, the tension factor can be detected at an appropriate timing in consideration of such posture and movement. As a result, the brace can be fixed more appropriately.

In addition, the assisting device control system of the disclosure may include a notification part which notifies; and a first notification instruction part enabling the notification part to notify that the tension is within the permission range if the recognized tension is within the permission range before driving of the assisting mechanism is started.

The wearer, etc. may not have sufficient knowledge about wearing the assisting device. Therefore, when the assisting device control system is configured to notify that the tension is within the permission range at the time of wearing, the brace can be fixed appropriately even if the wearer, etc. does not have sufficient knowledge.

In addition, the assisting device control system of the disclosure may include a notification part which notifies; and a second notification instruction part enabling the notification part to notify that the tension is not within the permission range if the recognized tension is not within the permission range after driving of the assisting device is started.

The fixed state of the brace is not always constant, and varies depending on the posture and movement of the wearer after the driving of the assisting device is started (that is, after the application of the assisting force is started). Therefore, even if the brace is fixed appropriately at the time of wearing, the fixed state of the brace may become inappropriate thereafter, which causes the wearer to feel uncomfortable or causes an inappropriate assisting force to be applied.

Therefore, with such a configuration, it is possible for the wearer, etc. to easily understand that the fixed state of the brace is not appropriate even after the driving of the assisting device is started. Thus, it is possible to appropriately fix the brace again and maintain the appropriate fixed state of the brace.

In addition, in the assisting device control system of the disclosure, the driving control part may stop driving of the assisting mechanism if the recognized tension is not within the permission range after driving of the assisting device is started.

Even if the tension of the brace is not within the permission range, the wearer, etc. may not immediately notice this, for example, when the wearer is moving. In such a case, the assisting force applied to the wearer may cause the wearer to feel uncomfortable.

Therefore, with such a configuration, although the assisting force cannot be applied to the wearer when the fixed state of the brace becomes inappropriate, it is possible to prevent the wearer from feeling uncomfortable due to the assisting force applied.

A driving permission range deciding method of the disclosure is for deciding a permission range in an assisting device control system, which controls an assisting device and includes: a tension recognition part recognizing a tension when a brace is worn on a predetermined portion of a body of a wearer; a driving control part permitting driving of an assisting mechanism, which moves the brace to apply an assisting force corresponding to movement of the wearer to the body of the wearer, if the recognized tension is within the permission range that has a predetermined lower limit value and a predetermined upper limit value; and a range deciding part deciding the permission range, wherein the assisting device includes the brace and the assisting mechanism. The assisting device control system includes a data storage part storing tensions recognized during previous uses of the assisting device or assisting equipment corresponding to the assisting device. The driving permission range deciding method includes: a step that the range deciding part decides a permission range for a current use based on the tensions recognized during the previous uses.

Here, the "assisting equipment corresponding to the assisting device" refers to a device or equipment which can recognize the tension that can be used to decide the permission range related to the assisting device that sets the current permission range. For example, the assisting equipment corresponding to the assisting device includes not only an assisting device having the same configuration as the current assisting device, but also an assisting device of a different shape including a brace similar to the brace of the current assisting device, test equipment for the purpose of measuring the design and function of an assisting device instead of applying an assisting force, etc.

As described above, in the driving permission range deciding method of the disclosure, the permission range of tension for the current use is decided based on the tensions recognized during the previous uses related to the same assisting device or the assisting equipment corresponding to the assisting device.

That is, in the driving permission range deciding method, the permission range is decided based on proven tension that has been determined to be appropriate in the past. Therefore, according to the driving permission range deciding method, it is possible to decide a permission range with high probability of appropriately fixing the brace to the body of the wearer.

In addition, in the driving permission range deciding method of the disclosure, the assisting device control system may include a wearer attribute recognition part recognizing a wearer attribute, which is an attribute of a current wearer who is the wearer wearing the assisting device in current use. The data storage part may associate and store a wearer attribute of a past wearer who is the wearer wearing the assisting device or the assisting equipment corresponding to the assisting device during the previous uses, and the tensions recognized during the previous uses. The driving permission range deciding method may include a step that the range deciding part decides the permission range based on the wearer attribute of the current wearer and the tension associated with the wearer attribute of the past wearer corresponding to the wearer attribute.

Here, the "wearer attribute" includes not only physical attributes such as gender, age, height, weight, etc., but also the personality of the wearer, the wishes of the wearer (for example, the movement the user wants to perform as a result of the training or rehabilitation performed using the assisting device (for example, walking)), the medical condition that results in the rehabilitation using the assisting device and the timing thereof, and the progress of the rehabilitation, etc.

Although the appropriate tension differs between wearers, the tension can be standardized to some extent depending on the wearer attribute. Therefore, as described above, if the tension setting is stored together with the wearer attribute, and the permission range for the current use is decided with reference to the tension corresponding to the wearer attribute that corresponds to the wearer attribute of the current wearer, the permission range can be set more appropriately. As a result, the brace can be more appropriately fixed to the body of the wearer.

In addition, in the driving permission range deciding method of the disclosure, the data storage part may store a setter attribute, which is an attribute of a setter, together with tensions set by the setter during the previous uses, and the driving permission range deciding method may include a step that the range deciding part decides the permission range based on the tension set by the setter having a predetermined setter attribute among the tensions set during the previous uses.

Here, the "setter attribute" includes not only information for identifying the setter (for example, name, affiliation, ID number, etc.), but also information indicating the skill held by the setter (whether the person supervises rehabilitation such as PT).

The appropriate tension differs depending on the type of the wearer, the purpose of use of the assisting device, etc. For example, since the shape of the body of the wearer differs between wearers, the tension appropriate for one wearer is not necessarily appropriate for another wearer. In addition, for example, the tension appropriate for applying an assisting force for assisting movement is not necessarily appropriate for applying an assisting force for rehabilitation (that is, an assisting force for hindering movement).

Therefore, as described above, if the tension is stored together with the setter attribute, which is the attribute of the setter of the tension (for example, the person himself/herself or a person who has sufficient knowledge such as a physical therapist), and the tension to be referred to is decided based on the setter attribute when the permission range for the next and subsequent uses is set, the permission range for the current use can be decided after referring to the tension set based on the preference of the person and the tension set by a person who has sufficient knowledge.

Thus, the decided permission range can be set more appropriately. As a result, the brace can be more appropriately fixed to the body of the wearer.

In addition, in the driving permission range deciding method of the disclosure, the tensions recognized during the previous uses may be tensions that are recognized when the wearer of the previous uses performs predetermined movement for a predetermined period after application of the assisting force is started at a time of start of the previous uses.

The fixed state of the brace is not always constant, and varies depending on the posture and movement of the wearer after the driving of the assisting device is started (that is, after the application of the assisting force is started). Therefore, in order to prevent a sense of incongruity that is imparted while the assisting force is being applied or to apply an appropriate assisting force, it is necessary to set the tension recognized when the wearer performs predetermined movement for a predetermined period appropriately after the application of the assisting force is started.

Therefore, as described above, if the tension recognized when the wearer performs the predetermined movement for a predetermined period after the application of the assisting force is started during the previous uses is used as the tension of the previous uses, which is the data to be referred to, the permission range thus set is appropriate after the application of the assisting force is started. Thus, the brace can be more appropriately fixed to the body of the wearer while the assisting force is being applied.

In addition, in the driving permission range deciding method of the disclosure, the assisting device control system may include an environment recognition part recognizing a surrounding environment which is an environment of a space where the wearer exists, and the driving permission range deciding method may include a step that the range deciding part decides the permission range based on the tensions recognized during the previous uses and the surrounding environment for the current use.

The appropriate tension also varies depending on the surrounding environment which is the environment of the space where the wearer exists. For example, in summer, the clothes worn on the wearer are thinner than those in winter, so the tension set with reference to winter may result in insufficient fixation of the brace. Therefore, as described above, if the permission range is decided based on the surrounding environment, the permission range can be set more appropriately. As a result, the brace can be more appropriately fixed to the body of the wearer.

Hereinafter, a control system S (assisting device control system) according to an embodiment and a driving permission range deciding method performed when the control system S is used will be described with reference to the drawings.

Here, the "permission range" decided by the driving permission range deciding method refers to a range of tension when a waist brace 10 and a leg brace 14 (will be described later) are respectively worn, and has predetermined lower and upper limit values. Therefore, strictly speaking, the driving permission range deciding method is a method of deciding the upper limit value and the lower limit value of the permission range.

The present embodiment illustrates a case where an assisting device 1 controlled by the control system S is used to perform rehabilitation related to walking of a wearer W who wears the assisting device 1. Therefore, an assisting force applied from the assisting device 1 to the body of the wearer W corresponds to the movement of the wearer W and hinders the movement.

However, the assisting device control system and the driving permission range deciding method of the disclosure are not necessarily related to the walking assisting device used for rehabilitation as in the present embodiment, and may be related to any assisting device that includes a brace worn on a predetermined portion of the body of the wearer, and an assisting mechanism moving the brace to apply an assisting force corresponding to the movement of the wearer to the body of the wearer.

For example, the assisting device may be used for training instead of rehabilitation. Furthermore, for example, the assisting device may apply an assisting force to the arm, waist, etc. of the wearer during movement of lifting an object in order to assist the movement.

[Schematic Configuration of Control System S]

First, a schematic configuration of the control system S will be described with reference to FIG. 1.

As shown in FIG. 1, the control system S includes: the assisting device 1, that is, the so-called walking assisting device, worn by the wearer W and assisting the walking of the wearer W; a tablet 2 which is an information terminal controlling the assisting device 1; and a server 3 which performs a process of deciding the permission range to be used for controlling the assisting device 1.

The assisting device 1 and the tablet 2 are configured to be able to communicate information with each other through wired communication such as a communication cable or wireless communication such as short-range wireless communication. Further, the tablet 2 and the server 3 are configured to be able to communicate information with each other through an Internet line, etc.

[Configuration of Assisting Device 1]

Next, a configuration of the assisting device 1 will be described with reference to FIG. 2 to FIG. 4.

Figure 2:
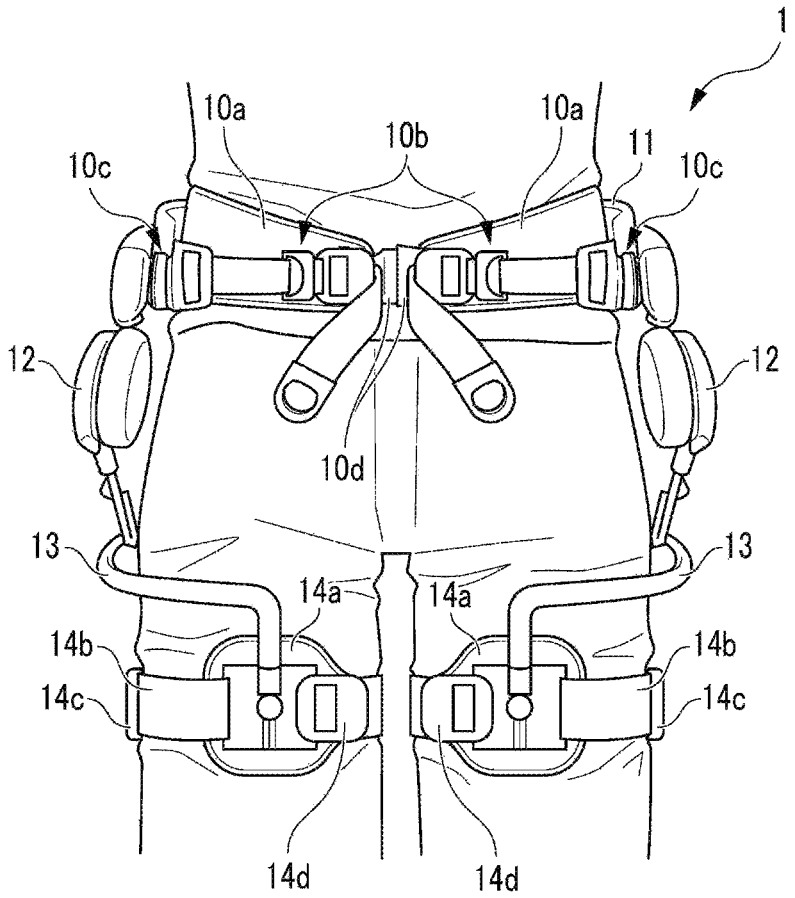
FIG. 2 is a front view showing a configuration of an assisting device controlled by the control system of FIG. 1.

As shown in FIG. 2, the assisting device 1 includes: a waist brace 10 worn on the waist of the wearer W; a main body part 11 fixed to cover two sides from the back of the waist of the wearer W via the waist brace 10; a pair of left and right actuators 12 respectively attached to the left and right sides of the main body part 11; a pair of left and right frames 13 respectively extending downward from the actuators 12; and a pair of left and right leg braces 14 attached to the ends on the lower side of the frames 13 and fixed to the thighs of the wearer W.

In the assisting device 1, the pair of left and right actuators 12 and the pair of left and right frames 13 constitute an assisting mechanism. The assisting mechanism moves the leg braces 14 with respect to the waist brace 10 to apply an assisting force corresponding to the movement of the wearer W to the body of the wearer W.

The waist brace 10 has a waist pad 10*a* to which the main body part 11 is fixed and which contacts two sides from the back of the waist of the wearer W when worn; and a pair of left and right waist belts 10*b* provided along the waist pad 10*a* on the outer peripheral side of the waist pad 10*a*. The waist pad 10*a* (ultimately, the assisting device 1) is fixed to the wearer W by tightening the waist belts 10*b*.

Each of the pair of left and right waist belts 10*b* is provided with a first adjusting mechanism 10*c* for adjusting the length of the waist belt 10*b*. The tension when the waist belt 10*b* is tightened is adjusted by adjusting the length of the waist belt 10*b* with the first adjusting mechanism 10*c*. In addition, a first buckle 10*d* that can be connected to each other is provided at the tip of each waist belt 10*b*.

Figure 3:
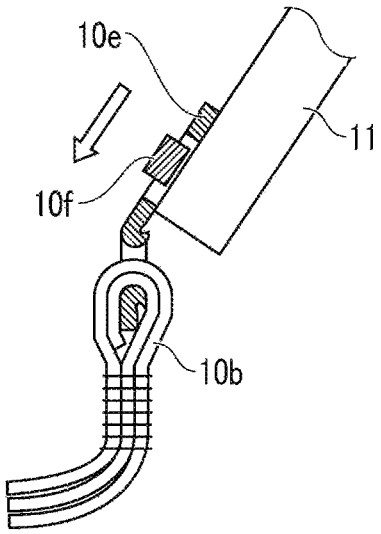
FIG. 3 is a schematic view enlarging and schematically showing a configuration of a fixed portion between a main body part and a waist belt of a waist brace of the assisting device of FIG. 2.

As shown in FIG. 3, the waist belt 10*b* is partially fixed to the main body part 11 via a first belt anchor 10*e*. The first belt anchor 10*e* is provided with a waist sensor 10*f*.

The waist sensor 10*f* detects the tension of the waist belt 10*b* (that is, the fixed state around the waist of the wearer W) according to a command from the tablet 2. The tension thus detected is used as a tension factor when recognizing the fixed state of the waist brace 10, and the tension factor is a factor related to the tension when the waist brace 10 is worn.

Here, the "tension factor" includes not only the tension itself when the brace is worn, but also a factor that can be used to estimate the tension. For example, the tension factor includes the stress applied to a frame for connecting the braces, the output of a driving source that generates a driving force for moving the braces, etc. Further, the tension when the wearer wears a brace worn on a first portion of the body may be used as a tension factor to estimate the tension when the wearer wears a brace worn on a second portion of the body.

In addition, the waist sensor 10*f* is not necessarily installed in the first belt anchor 10*e*, and may be installed in any position where the tension factor of the waist belt 10*b* can be detected.

As shown in FIG. 2, a portion of the main body part 11, which is the front of the wearer W when worn, is open and has a substantially C-shape in the plan view. The main body part 11 has therein a control device (not shown) for controlling the driving (ultimately, the assisting force) of the actuators 12, a communication device (not shown) for communicating information mutually with the tablet 2, and a speaker 11*a* (notification part, not shown in FIG. 2, see FIG. 6) for notifying the wearer W.

In the disclosure, the notification part provided in the assisting device may be any device that is able to notify the wearer and a person who enables the wearer to use the assisting device. Therefore, for example, in the assisting device 1 of the present embodiment, a small display may be provided instead of the speaker 11*a*, or they may be used together.

Each of the pair of left and right actuators 12 is independently driven according to a signal transmitted from the tablet 2 via the communication part of the main body part 11, and cooperates with the corresponding frame 13 and leg brace 14 to independently apply the assisting force to each of the left and right thighs of the wearer W.

Each of the pair of left and right frames 13 is connected to the corresponding actuator 12 at the upper end and connected to the corresponding leg brace 14 at the lower end. Each of the frames 13 independently rotates around a pitch axis that passes through the vicinity of the center of the hip joint of the wearer W so as to swing the corresponding leg brace 14 in the front-rear direction during walking of the wearer W according to the driving force from the corresponding actuator 12.

Each of the pair of left and right leg braces 14 has a leg pad 14*a* to which the corresponding frame 13 is connected, and a leg belt 14*b* extending from a side edge which is the outer side when the leg pad 14*a* is worn. When worn, the leg pad 14*a* contacts the front of the corresponding thigh of the wearer W. The leg pad 14*a* (ultimately, the entire leg brace 14) is fixed to the thigh of the wearer W by tightening the leg belt 14*b*.

Each of the leg belts 14*b* is provided with a second adjusting mechanism 14*c* for adjusting the length of the leg belt 14*b*. The tension when the leg belt 14*b* is tightened is adjusted by adjusting the length of the leg belt 14*b* with the second adjusting mechanism 14*c*. Further, a second buckle 14*d* that can be connected to each other is provided at the tip of each leg belt 14*b* and at a side edge which is the inner side when the corresponding leg pad 14*a* is worn.

Figure 4:
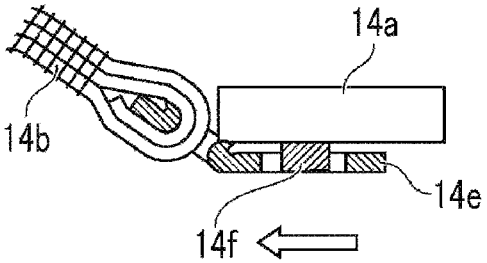
FIG. 4 is a schematic view enlarging and schematically showing a configuration of a fixed portion between a leg pad and a leg belt of a leg brace of the assisting device of FIG. 2.

As shown in FIG. 4, each of the leg belts 14*b* is fixed to the main body part 11 at the base end via a second belt anchor 14*e*. A right leg sensor 14*f* is provided in the second belt anchor 14*e* of the leg brace 14 on the right side. A left leg sensor 14*g* (see FIG. 5) is provided in the second belt anchor 14*e* of the leg brace 14 on the left side.

The right leg sensor 14*f* and the left leg sensor 14*g* detect the tension of the corresponding leg belt 14*b* (that is, the fixed state around the left and right thighs of the wearer W) according to a command from the tablet 2. The tension thus detected is used as a tension factor when recognizing the fixed state of the leg brace 14, and the tension factor is a factor related to the tension when the leg brace 14 is worn.

The right leg sensor 14*f* and the left leg sensor 14*g* are not necessarily installed in the second belt anchors 14*e*, and may be installed in any position where the tension factor of the corresponding leg belt 14*b* can be detected.

[Configuration of Tablet 2]

Next, a configuration of the tablet 2 will be described with reference to FIG. 1.

The tablet 2 is an information terminal for inputting information necessary for controlling the assisting device 1 and presenting information transmitted from the assisting device 1 or the server 3. Therefore, the tablet 2 is constituted by an input part for inputting information and an output part 20 (notification part, see FIG. 5) for presenting information by a touch panel, a speaker, a microphone, a camera, etc. included in the tablet 2.

In the present embodiment, the assisting device 1 is used for the purpose of rehabilitation. Therefore, information is input to the tablet 2 not only by the wearer W who performs rehabilitation, but also by a physical therapist (hereinafter referred to as "PT") who supervises the rehabilitation of the wearer W.

The information terminal that can be used in the assisting device control system of the disclosure is not limited to a tablet as in the present embodiment, and may be any device that allows the wearer to input information or give a setting command to the assisting device. For example, the information terminal may be a smartphone, etc. or a personal computer connected to the assisting device by wire.

[Configuration of Processing Part of Control System S]

Next, processing parts for executing the processes performed using the control system S will be described with reference to FIG. 5.

Figure 5:
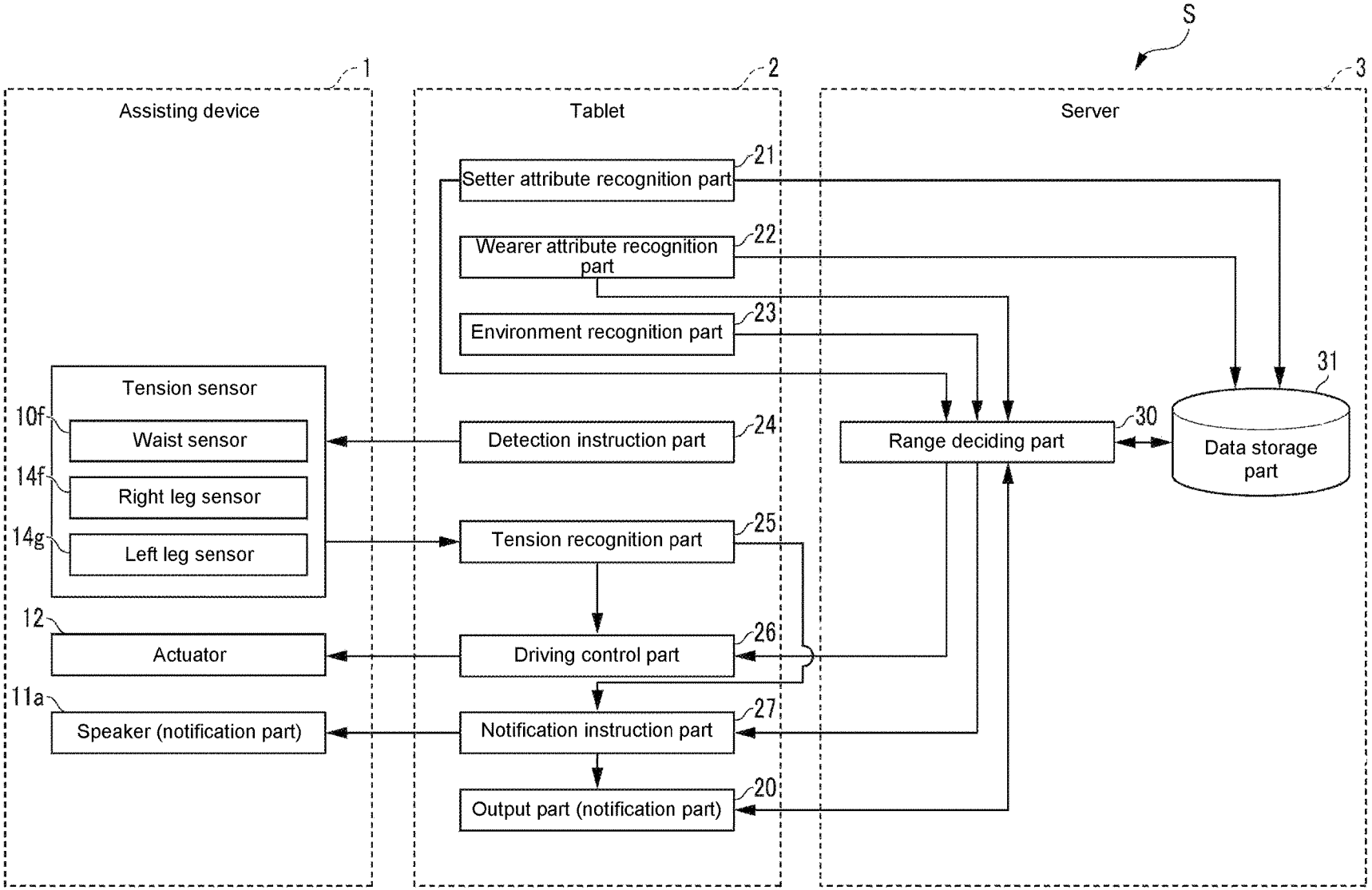
FIG. 5 is a block diagram showing a system configuration of the control system of FIG. 1.

As shown in FIG. 5, the tablet 2 and the server 3 includes: a setter attribute recognition part 21, a wearer attribute recognition part 22, an environment recognition part 23, a detection instruction part 24, a tension recognition part 25, a driving control part 26, a notification instruction part 27 (first notification instruction part, second notification instruction part), a range deciding part 30, and a data storage part 31 as functions (processing parts) realized by the installed hardware configuration or program.

The setter attribute recognition part 21 recognizes a setter attribute, which is an attribute of a setter who sets the permission range (specifically, fixing of the waist brace 10 and the leg brace 14 or an instruction of fixing) for the current use of the control system S, based on the information input to the tablet 2.

Here, the "setter attribute" includes not only information for identifying the setter (for example, name, affiliation, ID number, etc.), but also information indicating the skill held by the setter (whether the person supervises rehabilitation such as PT).

The setter attribute recognized by the setter attribute recognition part 21 is transmitted to the range deciding part 30 and used for deciding the permission range. Further, the recognized setter attribute is stored in the data storage part 31 together with the decided permission range, and is used for deciding the permission range for the next and subsequent uses.

The wearer attribute recognition part 22 recognizes a wearer attribute, which is an attribute of the wearer W who wears the assisting device 1 for the current use of the control system S, based on the information input to the tablet 2.

Here, the "wearer attribute" includes not only physical attributes such as gender, age, height, weight, etc., but also the personality of the wearer, the wishes of the wearer (for example, the movement the wearer wants to perform as a result of the rehabilitation performed using the assisting device (for example, walking)), the medical condition that results in the rehabilitation using the assisting device and the timing thereof, and the progress of the rehabilitation, etc.

The wearer attribute recognized by the wearer attribute recognition part 22 is transmitted to the range deciding part 30 and used for deciding the permission range for the current use. Further, the recognized wearer attribute is stored in the data storage part 31 together with the decided permission range, and is used for deciding the permission range for the next and subsequent uses.

The environment recognition part 23 recognizes an environment (surrounding environment) of a space, in which the wearer W who wears the assisting device 1 exists for the current use of the control system S, based on the information input to the tablet 2.

Here, more specifically, the "surrounding environment" refers to the environment that affects the fixed state of the brace with respect to the body of the wearer.

For example, the season (more specifically, temperature, humidity, etc.) also corresponds to the surrounding environment. This is because the fixed state of the brace is influenced by the thickness and material of the clothes worn by the wearer, and the type of the clothes differs greatly depending on the season.

Further, for example, a location where the assisting device is used (more specifically, at home or in a rehabilitation space) also corresponds to the surrounding environment. This is because the rehabilitation environment (for example, walking on a flat floor or walking outdoor) differs depending on the location, so the required assisting force (ultimately, the fixed state of the brace) also differs.

The detection instruction part 24 transmits a signal instructing to detect the tension factor to the waist sensor 10*f*, the right leg sensor 14*f*, and the left leg sensor 14*g* according to a detection request from the wearer and the person who enables the wearer to use the assisting device (hereinafter referred to as "wearer, etc.") or in a predetermined control cycle (for example, every 10 seconds).

Here, the "detection request" is a signal caused by an operation of the wearer W, etc. and refers to a signal for instructing to detect the tension factor. In the present embodiment, when a detection instruction button displayed on the touch panel of the tablet 2 is touched, a signal corresponding to the detection request is transmitted to the assisting device 1.

By providing such a detection instruction part 24, with the control system S, the wearer W, etc. is able to detect the tension factor at any timing. Thus, with the control system S, the wearer W, etc. is able to detect the tension factor at an appropriate timing in consideration of the posture, movement, etc. of the wearer W.

The tension recognition part 25 recognizes the tension with respect to each of the waist sensor 10*f*, the right leg sensor 14*f*, and the left leg sensor 14*g* when worn based on the detection factors detected by the waist sensor 10*f*, the right leg sensor 14*f*, and the left leg sensor 14*g*. In the present embodiment, since the tension is directly recognized as the tension factor, the detected value is directly recognized as the tension.

The tension recognized by the tension recognition part 25 is transmitted to the driving control part 26 and the notification instruction part 27, and used to decide whether to drive the assisting device 1, whether to notify by the tablet 2, and the contents together with the permission range decided by the range deciding part 30.

The driving control part 26 controls the driving of the assisting mechanism (more specifically, the actuators 12 constituting the assisting mechanism) based on the tension recognized by the tension recognition part 25 and the permission range decided by the range deciding part 30.

Specifically, the driving control part 26 permits the driving of the assisting mechanism if the recognized tension is within the decided permission range, and does not permit the driving of the assisting mechanism if the recognized tension is beyond the permission range before the driving of the assisting device 1 is started (that is, when the waist brace 10 and the leg brace 14 are worn).

In addition, the driving control part 26 stops the driving of the assisting mechanism if the recognized tension is not within the decided permission range after the driving of the assisting device 1 is started (that is, the state where the assisting device 1 applies the assisting force to the body of the wearer W).

The notification instruction part 27 decides whether to notify and the contents based on the tension recognized by the tension recognition part 25 and the permission range decided by the range deciding part 30. Further, when deciding that it is necessary to notify, the notification instruction part 27 instructs at least one of the speaker 11*a* of the assisting device 1 and the output part 20 of the tablet 2 to notify.

Specifically, the notification instruction part 27 instructs to notify that the tension is within the permission range if the recognized tension is within the decided permission range before the driving of the assisting device 1 is started (that is, when the waist brace 10 and the leg brace 14 are worn).

By configuring such notification, with the control system S, the wearer W, etc. is able to appropriately wear and fix the waist brace 10 and the leg brace 14 (ultimately, the assisting device 1) even if the wearer W, etc. does not have sufficient knowledge.

In addition, the notification instruction part 27 instructs to notify that the tension is not within the permission range if the recognized tension is not within the decided permission range after the driving of the assisting device 1 is started (that is, the state where the assisting device 1 applies the assisting force to the body of the wearer W).

By configuring such notification, with the control system S, the wearer W, etc. is able to easily understand that the fixed state of the waist brace 10 and the leg brace 14 is not appropriate even after the driving of the assisting device 1 is started. Thus, it is possible to appropriately fix the waist brace 10 and the leg brace 14 again to maintain the appropriate fixed state of the waist brace 10 and the leg brace 14.

The range deciding part 30 decides the permission range for the current use based on the information input by the wearer W, etc. via the tablet 2 and the permission range for the past use of the assisting device 1 stored in the data storage part 31.

Specifically, for example, if the person who supervises the rehabilitation such as PT decides the permission range for the first time of rehabilitation, the range deciding part 30 acquires a permission range that is a reference from the data storage part 31 based on the wearer attribute of the wearer W who performs the rehabilitation, and then corrects the acquired permission range based on the surrounding environment that is the season when the wearer W performs the rehabilitation, to decide the permission range for the current use.

Further, for example, if the wearer W decides the permission range when performing the second and subsequent times of rehabilitation at home, the range deciding part 30 refers to the permission range associated with the setter attribute of the person who sets the permission range for the first time (that is, the attribute indicating the person who supervises the rehabilitation such as PT), to decide the permission range for the current use.

The data storage part 31 stores the permission ranges of tension recognized during the previous uses of the assisting device 1 or the assisting equipment corresponding to the assisting device 1.

Here, the "assisting equipment corresponding to the assisting device" refers to a device or equipment which can recognize the tension that can be used to decide the permission range related to the assisting device that sets the current permission range. For example, the assisting equipment corresponding to the assisting device includes not only an assisting device having the same configuration as the current assisting device, but also an assisting device of a different shape including a brace similar to the brace of the current assisting device, test equipment for the purpose of measuring the design and function of an assisting device instead of applying an assisting force, etc.

The setter attribute of the setter who sets the permission range is also stored in association with the permission range stored in the data storage part 31. In addition, the wearer attribute of the wearer who has worn the assisting device or the assisting equipment corresponding to the assisting device during the previous uses (hereinafter referred to as "past wearer") is also stored in association with the permission range.

Here, the permission range stored in the data storage part 31 is a range set with reference to the tension recognized during the previous uses. The tension is tension recognized when the past wearer performs predetermined movement for a predetermined period after the application of the assisting force is started at the time of start of the previous uses.

Specifically, for example, if the assisting device of the present embodiment is used for rehabilitation related to walking, the tension when the past wearer walks a predetermined distance under the supervision of the PT, etc. after wearing the waist brace and the leg brace in the standing state is the reference.

Thus, in the control system S, the tension recognized when the wearer performs the predetermined movement for a predetermined period after the application of the assisting force is started during the previous uses is used as the tension of the previous uses, which is data to be referred to when deciding the permission range for the current use. Thus, the permission range decided during the current use becomes an appropriate range after the application of the assisting force is started.

The configuration illustrated using FIG. 5 is an example of the assisting device control system of the disclosure. That is, the functions (processing parts) realized by the hardware configuration or program installed in the assisting device 1, the tablet 2, and the server 3 of the present embodiment are not necessarily configured as in the present embodiment.

For example, the functions (processing parts) may be realized using a hardware configuration or program installed in a plurality of servers instead of one single server. In addition, for example, a part of the processing parts provided in the server may be realized by a hardware configuration or program installed in the tablet or the assisting device. Further, for example, the functions (processing parts) may be realized using only the hardware configuration or program installed in the tablet or the assisting device without using the server.

Specifically, for example, in the present embodiment, the notification instruction part 27 of the tablet 2 is realized by the hardware configuration or program installed in the tablet 2, and enabled to function as not only the first notification instruction part but also the second notification instruction part in the disclosure. However, the second notification instruction part may be realized by the hardware configuration or program installed in the control device of the assisting device 1, so that the first notification instruction part and the second notification instruction part are independent of each other.

[Description of Processes Executed by Control System S]

Next, the processes that the control system S executes when the permission range is decided, when the brace is worn, and after the application of the assisting force is started will be described with reference to FIG. 5 to FIG. 11.

[Process When the Permission Range is Decided (for the First Time)]

Figure 6:
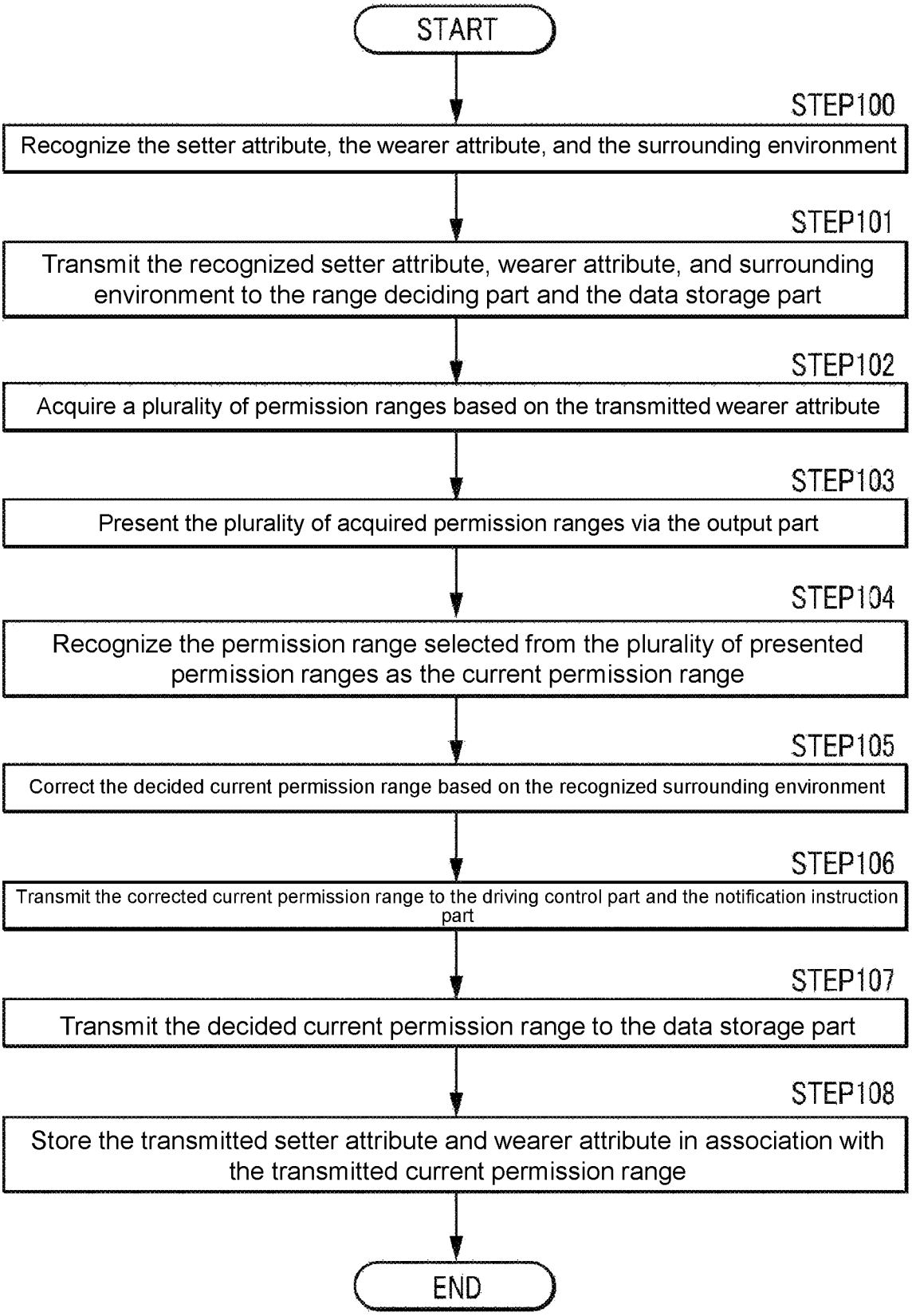
FIG. 6 is a flowchart showing a process that the control system of FIG. 1 executes when a permission range is decided for the first use of the assisting device.

First, the process that the control system S executes when the permission range is decided for the first use of the assisting device 1 will be described with reference to FIG. 5 and FIG. 6. FIG. 6 is a flowchart of the process.

As an example, the present embodiment illustrates the process that is executed when the PT sets the permission range of tension (ultimately, the assisting force) effective for rehabilitation in the case of using the assisting device 1 for rehabilitation.

In the process, first, the setter attribute recognition part 21, the wearer attribute recognition part 22, and the environment recognition part 23 of the tablet 2 recognize the setter attribute of the PT who is the setter, the wearer attribute of the wearer W who performs rehabilitation, and the surrounding environment of the wearer W (FIG. 6/STEP 100).

Specifically, the PT who is the setter inputs the setter attribute such as his/her name, affiliation, ID number, etc., the wearer attribute such as age, height, and weight of the wearer W who performs rehabilitation, the purpose of rehabilitation, the medical condition that results in the rehabilitation and the timing thereof, etc., and the surrounding environment such as the date and time (ultimately, season) and the location of rehabilitation (ultimately, temperature and humidity), etc. via the input part of the tablet 2.

Then, based on the input information, the setter attribute recognition part 21, the wearer attribute recognition part 22, and the environment recognition part 23 of the tablet 2 recognize the setter attribute, the wearer attribute, and the surrounding environment.

Next, the setter attribute recognition part 21, the wearer attribute recognition part 22, and the environment recognition part 23 transmit the recognized setter attribute, wearer attribute, and surrounding environment to the range deciding part 30 of the server 3, and transmit the setter attribute and the wearer attribute to the data storage part 31 (FIG. 6/STEP 101).

Next, the range deciding part 30 acquires a plurality of permission ranges from the data storage part 31 based on the transmitted wearer attribute (FIG. 6/STEP 102).

Specifically, the range deciding part 30 searches for and acquires the permission range associated with the wearer attribute corresponding to the transmitted wearer attribute from the permission ranges stored in the data storage part 31.

Next, the range deciding part 30 presents the plurality of acquired permission ranges to the setter via the output part 20 of the tablet 2 (FIG. 6/STEP 103).

Specifically, a list of permission ranges and the corresponding wearer attributes is transmitted from the range deciding part 30 of the server 3 to the tablet 2, and is selectably displayed on a touch panel which is a part of the output part 20 of the tablet 2.

Next, the range deciding part 30 recognizes the permission range selected by the setter from the plurality of presented permission ranges as the permission range for the current use (FIG. 6/STEP 104).

Specifically, the range deciding part 30 recognizes the permission range selected by the setter from the permission ranges displayed on the touch panel of the tablet 2, and decides the permission range as the permission range for the current use.

Next, the range deciding part 30 corrects the decided permission range for the current use based on the recognized surrounding environment (FIG. 6/STEP 105).

Specifically, the range deciding part 30 performs correction with respect to each of the lower limit value and the upper limit value of the decided permission range for the current use by adding a correction value set for each surrounding environment. The correction of the permission range for the current use may not only be performed by the control system S referring to the surrounding environment, but also be directly input by the setter via the tablet 2.

Next, the range deciding part 30 transmits the corrected permission range for the current use to the driving control part 26 and the notification instruction part 27 of the tablet 2 (FIG. 6/STEP 106).

Next, the range deciding part 30 transmits the decided permission range for the current use to the data storage part 31 of the server 3 (FIG. 6/STEP 107).

Next, the data storage part 31 stores the previously transmitted setter attribute and wearer attribute in association with the transmitted permission range for the current use (FIG. 6/STEP 108), and ends the process.

[Process When the Permission Range is Decided (for the Second and Subsequent Times)]

Figure 7:
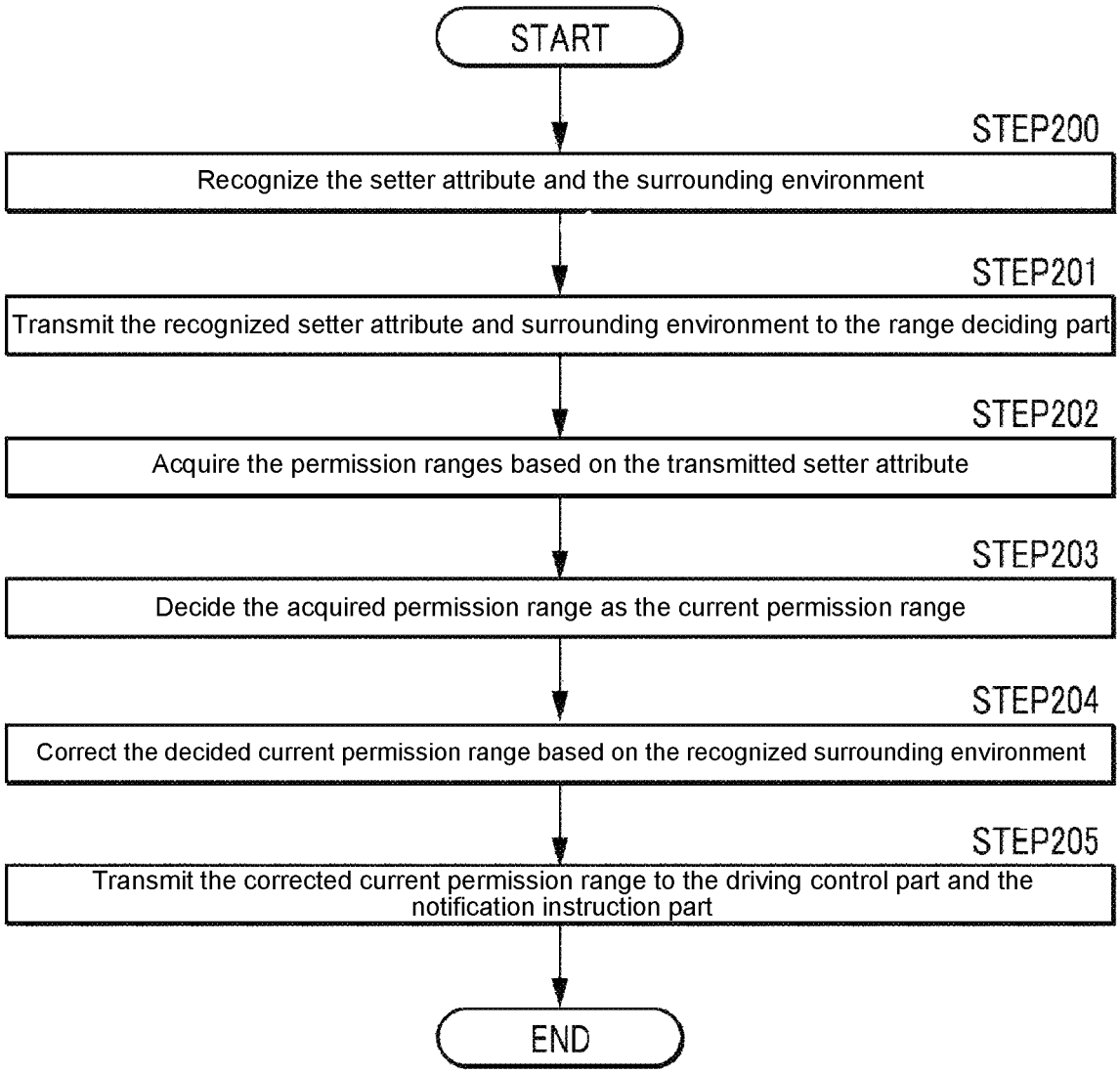
FIG. 7 is a flowchart showing a process that the control system of FIG. 1 executes when a permission range is decided for the second and subsequent uses of the assisting device.

Next, the process that the control system S executes when the permission range is decided for the second and subsequent uses of the assisting device 1 will be described with reference to FIG. 5 and FIG. 7. FIG. 7 is a flowchart of the process.

For example, the process is executed when the wearer W reproduces the permission range (ultimately, the assisting force) set by the PT in the case of using the assisting device 1 for rehabilitation.

In the process, first, the setter attribute recognition part 21 and the environment recognition part 23 of the tablet 2 recognize the setter attribute of the PT who is the setter during the previous uses and the surrounding environment of the wearer W for the current use (FIG. 7/STEP 200).

Specifically, the wearer W inputs the setter attribute such as the name, affiliation, ID number, etc. of the PT who is the person in charge of rehabilitation and is the setter during the previous uses, and the surrounding environment such as the date and time (ultimately, season) and the location of rehabilitation (ultimately, temperature and humidity), etc. via the input part of the tablet 2. Then, based on the input information, the setter attribute recognition part 21 and the environment recognition part 23 of the tablet 2 recognize the setter attribute and the surrounding environment.

Next, the setter attribute recognition part 21 and the environment recognition part 23 transmit the recognized setter attribute and surrounding environment to the range deciding part 30 of the server 3 (FIG. 7/STEP 201).

Next, the range deciding part 30 acquires the permission ranges from the data storage part 31 based on the transmitted setter attribute (FIG. 7/STEP 202).

Specifically, the range deciding part 30 searches for and acquires the permission range associated with the setter attribute that matches the transmitted setter attribute from the permission ranges stored in the data storage part 31.

Next, the range deciding part 30 decides the acquired permission range as the permission range for the current use (FIG. 7/STEP 203).

Next, the range deciding part 30 corrects the decided permission range for the current use based on the recognized surrounding environment (FIG. 7/STEP 204).

Specifically, the range deciding part 30 performs correction with respect to each of the lower limit value and the upper limit value of the decided permission range for the current use by adding a correction value set for each surrounding environment.

Next, the range deciding part 30 transmits the corrected permission range for the current use to the driving control part 26 and the notification instruction part 27 of the tablet 2 (FIG. 7/STEP 205), and ends the process.

[Decided Permission Range]

As described above, in the driving permission range deciding method executed in the control system S, the range deciding part 30 decides the permission range of tension for the current use based on the permission range of tension recognized during the previous uses.

That is, in the driving permission range deciding method, the permission range is decided based on proven tension that has been determined to be appropriate in the past. Therefore, according to the driving permission range deciding method, it is possible to decide a permission range with high probability of appropriately fixing the brace to the body of the wearer.

Although the appropriate permission range of tension differs between wearers, the permission range can be standardized to some extent depending on the wearer attribute.

Thus, like the process executed when the permission range is decided (for the first time), when the permission range for the current use is decided, the permission range can be set more appropriately by referring to the permission range corresponding to the wearer attribute corresponding to the wearer attribute of the current wearer.

Further, the appropriate permission range of tension differs depending on the type of the wearer, the purpose of use of the assisting device, etc. For example, since the shape of the body of the wearer differs between wearers, the tension appropriate for one wearer is not necessarily appropriate for another wearer. In addition, for example, the tension appropriate for applying an assisting force for assisting movement is not necessarily appropriate for applying an assisting force for rehabilitation (that is, an assisting force for hindering movement).

Therefore, like the process executed when the permission range is decided (for the second and subsequent times), if the tension is stored together with the setter attribute, which is the attribute of the setter of the tension, and the tension to be referred to is decided based on the setter attribute when the permission range for the next and subsequent uses is set, the permission range for the current use can be decided after referring to the tension set based on the preference of the person and the tension set by a person who has sufficient knowledge. Thus, the decided permission range can be set more appropriately.

In the present embodiment, when the permission range is decided (for the second and subsequent times), in order to reproduce the permission range set by a person who has sufficient knowledge such as the PT at the first time, the permission range is decided by referring to the setter attribute of another person such as the PT.

However, the disclosure is not limited to such a configuration. For example, the permission range for the current use may be decided by referring to one's own setter attribute. In this way, by referring to one's own setter attribute, it is possible to reproduce the permission range that the person thought to be easy to use during the previous uses.

Additionally, in the present embodiment, both the permission range decided for the first time and the permission range decided for the second and subsequent times are corrected with reference to the surrounding environment.

However, the disclosure is not limited to such a configuration. For example, the surrounding environment may be referred to for either the first time or the second and subsequent times, or the surrounding environment may not be referred to for both the first time and the second and subsequent times.

Further, in the present embodiment, the surrounding environment is referred to only for the correction for deciding the permission range for the current use, and the surrounding environment is not stored. However, the disclosure is not limited to such a configuration.

For example, the surrounding environment used for the correction may be recorded together with the permission range decided or the permission range corrected during the current use or the tensions corresponding to these permission ranges, and the permission range serving as the reference may be acquired based on the surrounding environment during the next and subsequent uses.

[Process When the Brace is Worn]

Figure 8:
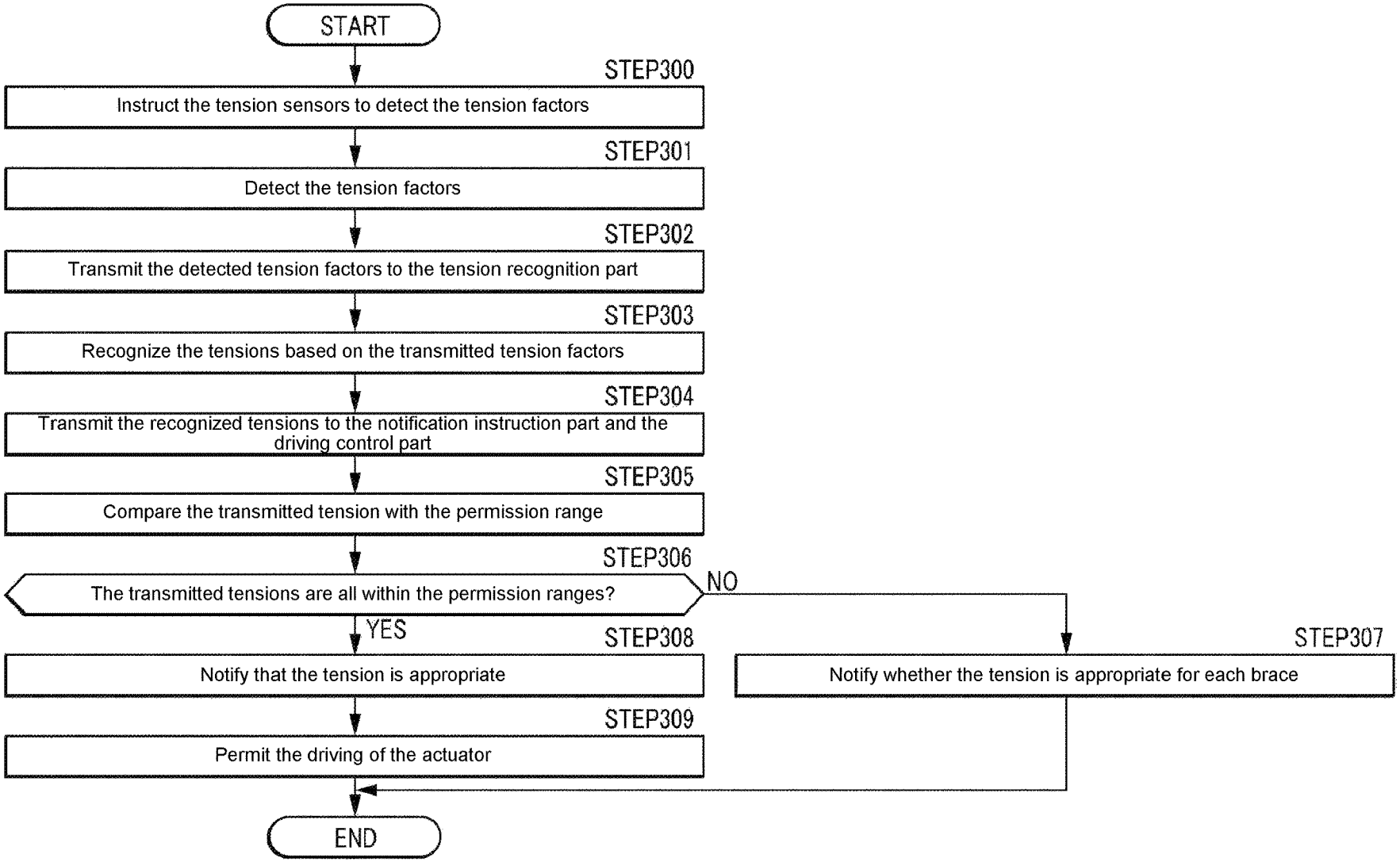
FIG. 8 is a flowchart showing a process that the control system of FIG. 1 executes when a brace is fixed.
Figure 9:
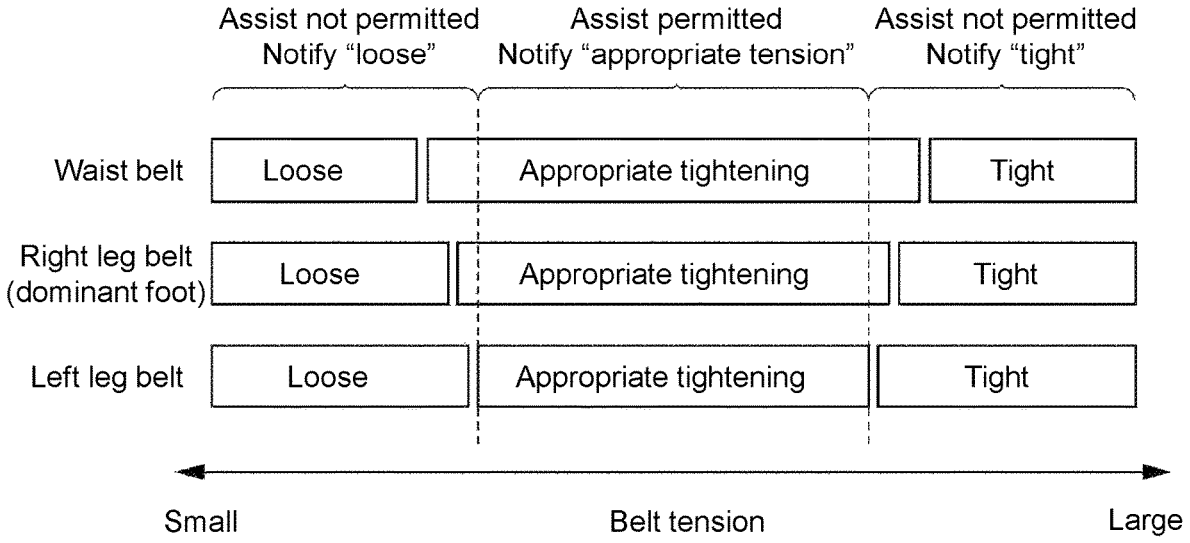
FIG. 9 is an explanatory diagram schematically showing the permission range in the control system of FIG. 1.
Figure 10:
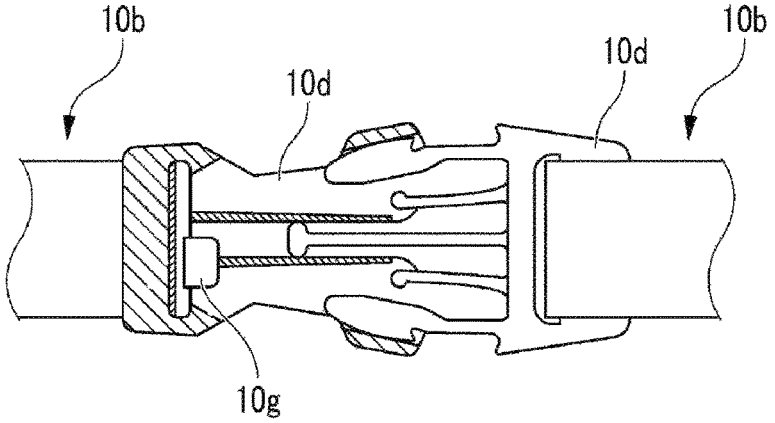
FIG. 10 is a front view showing a configuration of a buckle part of the waist brace of the assisting device according to a modified example.

Next, the process that the control system S executes when the waist brace 10 and the leg braces 14 are fixed to the body of the wearer W will be described with reference to FIG. 5, FIG. 8, and FIG. 9. FIG. 8 is a flowchart of the process.

As a premise, it is assumed that in the stage before the process is executed, the waist brace 10 and the leg braces 14 of the assisting device 1 are fixed to the body of the wearer W, and the wearer W maintains a standing still state.

In the process, first, the detection instruction part 24 of the tablet 2 instructs the waist sensor 10*f*, the right leg sensor 14*f*, and the left leg sensor 14*g*, which are tension sensors of the assisting device 1, to detect the tension factor (FIG. 8/STEP 300).

Specifically, after the power switches of the assisting device 1 and the tablet 2 are turned on, the detection instruction part 24 displays a detection instruction button on the touch panel of the tablet 2. Then, the detection instruction part 24 transmits a signal instructing detection of the tension factor to each of the waist sensor 10*f*, the right leg sensor 14*f*, and the left leg sensor 14*g* at a timing at which the detection instruction button is touched by the wearer W (that is, a timing at which the detection request of the wearer W, etc. is recognized).

Next, the waist sensor 10*f*, the right leg sensor 14*f*, and the left leg sensor 14*g* detect the tension factors in the waist brace 10 and the pair of left and right leg braces 14 (FIG. 8/STEP 301).

In the present embodiment, the tension is directly used as the tension factor. Therefore, in the process, the waist sensor 10*f*, the right leg sensor 14*f*, and the left leg sensor 14*g* recognize the tension in the waist belt 10*b* of the waist brace 10 and the tension in each of the leg belts 14*b* of the pair of left and right leg braces 14.

Next, the waist sensor 10*f*, the right leg sensor 14*f*, and the left leg sensor 14*g* transmit the detected tension factors to the tension recognition part 25 of the tablet 2 (FIG. 8/STEP 302).

Next, the tension recognition part 25 recognizes the tensions based on the transmitted tension factors (FIG. 8/STEP 303).

In the present embodiment, the tension is directly used as the tension factor. Therefore, in the process, the tension recognition part 25 recognizes the transmitted tension as the tension directly.

Next, the tension recognition part 25 transmits the recognized tension to the notification instruction part 27 and the driving control part 26 of the tablet 2 (FIG. 8/STEP 304).

Next, the notification instruction part 27 and the driving control part 26 compare each transmitted tension with the permission range transmitted from the range deciding part 30 of the server 3 in the process of deciding the permission range (FIG. 8/STEP 305).

Specifically, the notification instruction part 27 and the driving control part 26 determine whether the tension in the waist belt 10*b* of the waist brace 10 and the tension in each of the leg belts 14*b* of the pair of left and right leg braces 14 are within the "appropriate tightening" ranges (see FIG. 9) of the corresponding permission ranges.

Next, the notification instruction part 27 and the driving control part 26 determine whether the transmitted tensions are all within the permission ranges (FIG. 8/STEP 306).

If it is determined that at least one of the transmitted tensions is not within the permission range (NO in STEP 306), the notification instruction part 27 notifies the wearer W, etc. whether the tension (ultimately, the fixed state) with respect to each of the waist brace 10 and the pair of left and right leg braces 14 is appropriate, too tight, or too loose (see FIG. 9) via the output part 20 such as the touch panel of the tablet 2 and the speaker 11*a* of the assisting device 1 (FIG. 8/STEP 307), and ends the process.

Thereafter, the wearer W reviews the fixed states of the waist brace 10 and the leg braces 14 in consideration of the contents of the notification. Then, when the control system S recognizes the detection request again, the control system S executes the process of STEP 300 to STEP 306 again.

On the other hand, when it is determined that the transmitted tensions are all within the permission ranges (YES in STEP 306), the notification instruction part 27 notifies the wearer W, etc. that the tensions of the waist brace 10 and the pair of left and right leg braces 14 (ultimately, the fixed states) are appropriate (FIG. 8/STEP 308) via the output part 20 such as the touch panel of the tablet 2 and the speaker 11*a* of the assisting device 1.

Next, the driving control part 26 transmits a signal permitting the driving of the actuator 12 (ultimately, the assisting mechanism configured by using the actuator 12) to the assisting device 1 (FIG. 8/STEP 309), and ends the process.

As described above, the control system S is configured to permit the driving of the assisting mechanism when the recognized tension is within the permission range having the predetermined lower limit value and the predetermined upper limit value.

Therefore, in the control system S, the driving of the assisting mechanism is not permitted not only when the tension is equal to or smaller than the predetermined lower limit value and any one of the waist brace 10 and the pair of left and right leg braces 14 is not fixed to the body of the wearer W, but also when the tension is equal to or greater than the predetermined upper limit value and any one of the waist brace 10 and the pair of left and right leg braces 14 is fixed with an excessive force.

Thus, according to the control system S, the assisting force is applied to the wearer W only when the waist brace 10 and the pair of left and right leg braces 14 are fixed with appropriate forces. As a result, with the assisting device 1 controlled by the control system S, it is possible to prevent the wearer W from feeling uncomfortable and prevent an inappropriate assisting force from being applied when the assisting force is applied.

In the present embodiment, the control system S permits the driving of the assisting device only when the tensions in all of the waist brace 10 and the pair of left and right leg braces 14 are within the permission ranges. However, the assisting device control system of the disclosure is not limited to such a configuration. For example, the driving of the assisting device may be permitted when the tension in at least one of a plurality of braces is within the permission range.

In addition, in the present embodiment, the tension factor is detected when the wearer W is in the standing still state. However, the assisting device control system of the disclosure is not limited to such a configuration, and the posture of the wearer at the time of detection may be set appropriately according to the structure of the assisting device, the purpose of use, etc. For example, detection may be performed after the wearer wears the braces and walks for a predetermined distance.

Further, in the present embodiment, the tension which is the tension factor is detected when the wearer W, etc. touches the detection instruction button on the touch panel of the tablet 2. This is because the tension factor is detected at any timing of the wearer W by recognizing the detection request via the detection instruction part. This is because the tension factor is detected at an appropriate timing in consideration of the posture, movement, etc.

However, the assisting device control system of the disclosure is not limited to such a configuration. For example, as in a modified example shown in FIG. 10, a detection switch 10*g* that is turned on when the first buckle 10*d* is connected may be provided inside the first buckle 10*d* of the waist brace 10, and the tension factor may be detected at the time when the first buckle 10*d* is connected (that is, at the time when the waist brace 10 is worn).

Process After the Application of the Assisting Force is Started

Next, the process that the control system S executes after the application of the assisting force is started will be described with reference to FIG. 5, FIG. 11, and FIG. 12. FIG. 12 is a flowchart of the process.

As a premise, it is assumed that in the stage before the process is executed, the waist brace 10 and the leg braces 14 are worn on the wearer W, and a signal permitting the driving has been transmitted from the driving control part 26 of the tablet 2 to the actuator 12 (ultimately, the assisting mechanism) of the assisting device 1.

Figure 11:
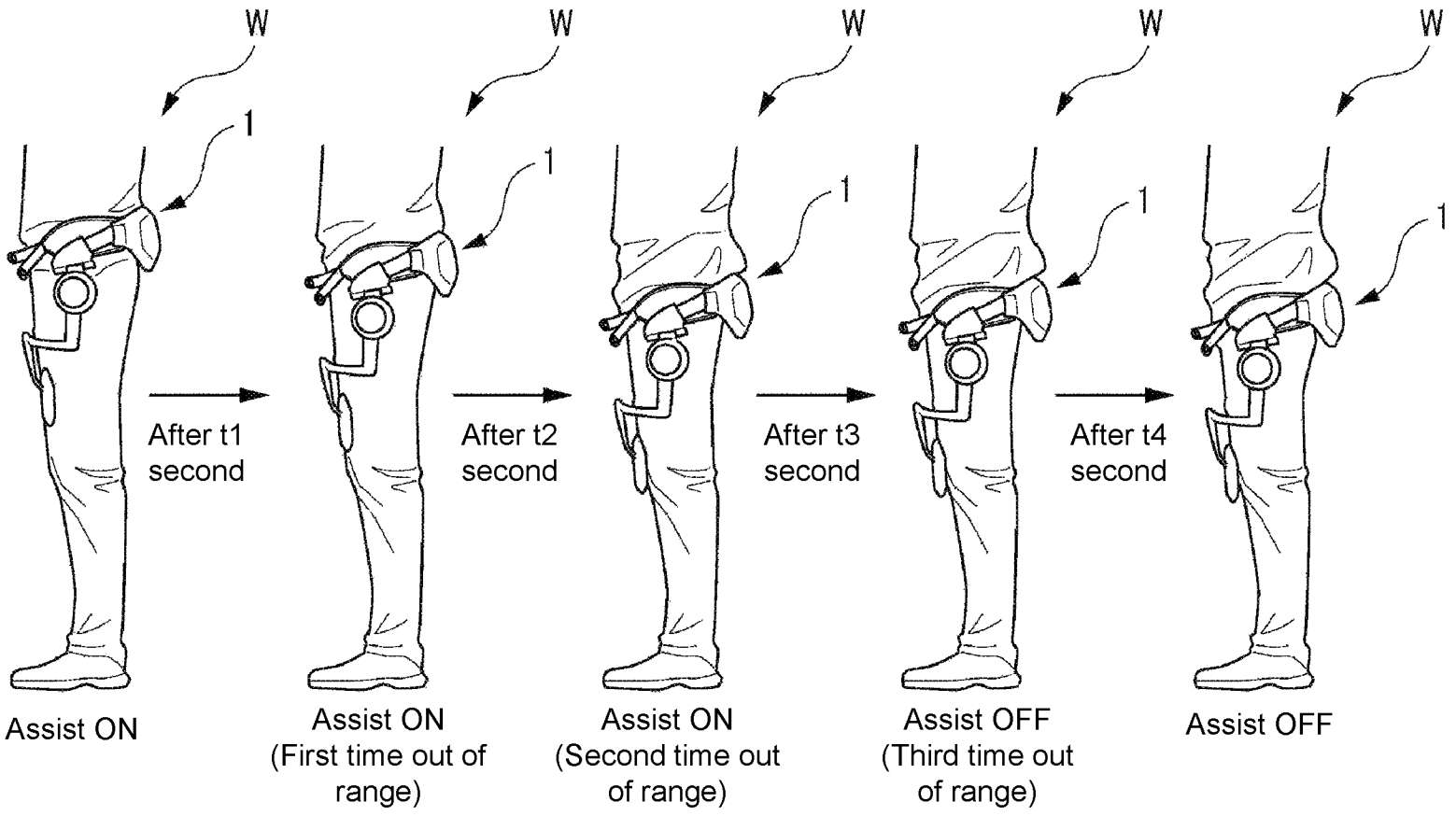
FIG. 11 is a side view showing a wearing position of the assisting device of FIG. 2 at each time.
Figure 12:
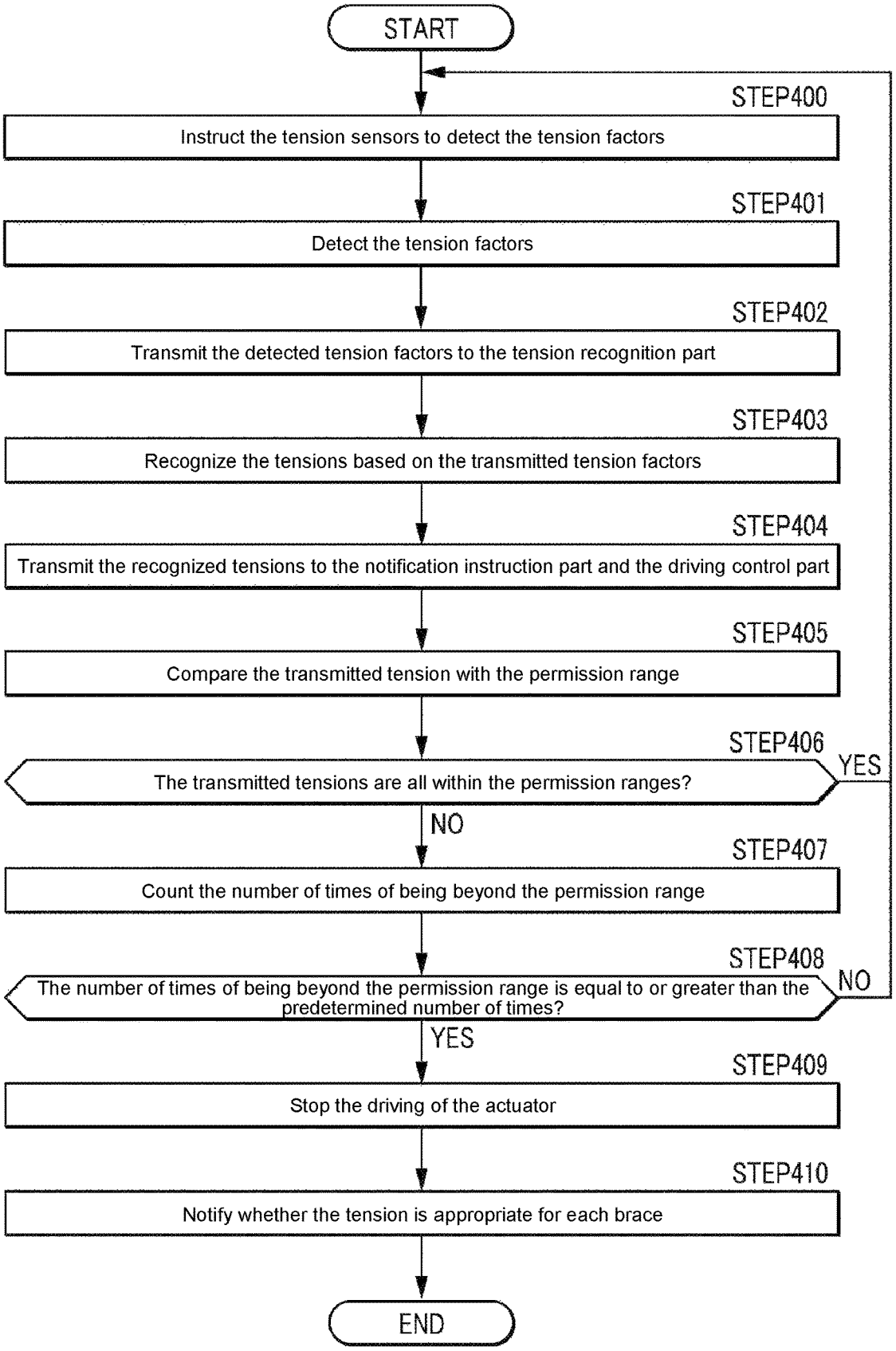
FIG. 12 is a flowchart showing a process that the control system of FIG. 1 executes after the application of an assisting force is started.

Then, the process is for example performed to cope with a case where the assisting device 1 slips down over time (as it progresses from t1 to t4) as the wearer W repeats the walking movement after the application of the assisting force is started, as shown in FIG. 11.

In the process, first, the detection instruction part 24 of the tablet 2 instructs the waist sensor 10*f*, the right leg sensor 14*f*, and the left leg sensor 14*g*, which are tension sensors of the assisting device 1, to detect the tension factor (FIG. 12/STEP 400).

Specifically, the detection instruction part 24 transmits a signal instructing detection of the tension factor to each of the waist sensor 10*f*, the right leg sensor 14*f*, and the left leg sensor 14*g* in a predetermined control cycle (for example, every 10 seconds).

Next, the waist sensor 10*f*, the right leg sensor 14*f*, and the left leg sensor 14*g* detect the tension factors in the waist brace 10 and the pair of left and right leg braces 14 (FIG. 12/STEP 401).

In the present embodiment, the tension is directly used as the tension factor. Therefore, in the process, the waist sensor 10*f*, the right leg sensor 14*f*, and the left leg sensor 14*g* recognize the tension in the waist belt 10*b* of the waist brace 10 and the tension in each of the leg belts 14*b* of the pair of left and right leg braces 14.

Next, the waist sensor 10*f*, the right leg sensor 14*f*, and the left leg sensor 14*g* transmit the detected tension factors to the tension recognition part 25 of the tablet 2 (FIG. 12/STEP 402).

Next, the tension recognition part 25 recognizes the tensions based on the transmitted tension factors (FIG. 12/STEP 403).

In the present embodiment, the tension is directly used as the tension factor. Therefore, in the process, the tension recognition part 25 recognizes the transmitted tension as the tension directly.

Next, the tension recognition part 25 transmits the recognized tension to the notification instruction part 27 and the driving control part 26 of the tablet 2 (FIG. 12/STEP 404).

Next, the notification instruction part 27 and the driving control part 26 compare each transmitted tension with the permission range transmitted from the range deciding part 30 of the server 3 in the process of deciding the permission range (FIG. 12/STEP 405).

Specifically, the notification instruction part 27 and the driving control part 26 determine whether the tension in the waist belt 10*b* of the waist brace 10 and the tension in each of the leg belts 14*b* of the pair of left and right leg braces 14 are within the "appropriate tightening" ranges (see FIG. 9) of the corresponding permission ranges.

Next, the notification instruction part 27 and the driving control part 26 determine whether the transmitted tensions are all within the permission ranges (FIG. 12/STEP 406).

If it is determined that the transmitted tensions are all within the permission ranges (YES in STEP 406), the process returns to STEP 400, and the control system S executes the process of STEP 400 to STEP 406 again.

On the other hand, if it is determined that at least one of the transmitted tensions is not within the permission range (NO in STEP 406), the notification instruction part 27 and the driving control part 26 increase the count of the number of times that the tension is not within the permission range (that is, the number of times that the tension is beyond the permission range) by 1 (FIG. 12/STEP 408).

Next, the notification instruction part 27 and the driving control part 26 determine whether the number of times that the tension is beyond the permission range is equal to or greater than a predetermined number of times (for example, 3 times) (FIG. 12/STEP 409).

If it is determined that the number of times that the tension is beyond the permission range is not equal to or greater than the predetermined number of times (NO in STEP 409), the process returns to STEP 400, and the control system S executes the process of STEP 400 to STEP 406 again.

On the other hand, if it is determined that the number of times that the tension is beyond the permission range is equal to or greater than the predetermined number of times (NO in STEP 410), the driving control part 26 transmits a signal stopping the driving of the actuator 12 (ultimately, the assisting mechanism configured by using the actuator 12) to the assisting device 1 (FIG. 12/STEP 409).

Next, the notification instruction part 27 notifies the wearer W, etc. whether the tension (ultimately, the fixed state) with respect to each of the waist brace 10 and the pair of left and right leg braces 14 is too tight or too loose (see FIG. 9) via the output part 20 such as the touch panel of the tablet 2 and the speaker 11*a* of the assisting device 1 (FIG. 12/STEP 410), and ends the process.

As described above, the control system S is configured to stop the driving of the assisting mechanism when the recognized tension is not within the permission range having the predetermined lower limit value and the predetermined upper limit value after the assisting force is started.

Thus, for example, after the application of the assisting force is started, if the tension of any one of the waist brace 10 and the pair of left and right leg braces 14 is not within the permission range and the fixed state thereof becomes inappropriate as a result of the assisting device 1 slipping down over time, as shown in FIG. 11, even though the wearer W may not be aware of this, the application of the assisting force is stopped.

Thus, although the assisting force cannot be applied to the wearer W when the fixed state becomes inappropriate, it is possible to prevent the wearer W from feeling uncomfortable due to the assisting force applied.

[Other Embodiments]

Although the illustrated embodiments have been described above, the disclosure is not limited to such embodiments.

For example, in the above embodiment, the assisting device 1 is configured to move the leg braces 14 with respect to the waist brace 10 to apply the assisting force corresponding to the movement of the wearer W to the body of the wearer W.

However, the assisting device according to the disclosure is not limited to such an assisting device, and may be any device which includes a brace worn on a predetermined portion of the body of the wearer, and an assisting mechanism moving the brace to apply the assisting force corresponding to the movement of the wearer to the body of the wearer.

Therefore, for example, the assisting device may be a device that includes a waist brace and a foot brace, and swings the foot brace with respect to the waist brace to assist walking. Further, the assisting device may be a device that includes a seating part (hip joint brace), on which the wearer straddles, and a foot brace, and varies the distance between the seating part and the foot brace to assist the bending and stretching motion of the knee.

Furthermore, in the above embodiment, the data storage part 31 stores the permission range of tension as data of the previous uses. However, the disclosure is not limited to such a configuration, as long as the data storage part stores the tension for the previous uses. In that case, the range deciding part may decide the permission range with reference to the tension.

What is claimed is:

1. An assisting device control system controlling an assisting device, which comprises a brace worn on a predetermined portion of a body of a wearer, and an assisting mechanism moving the brace to apply an assisting force corresponding to movement of the wearer to the body of the wearer, the assisting device control system comprising:

a sensor detecting a tension factor, which is a factor related to a tension when the brace is worn;

a tension recognition part recognizing the tension from the detected tension factor; and a driving control part controlling driving of the assisting mechanism, wherein the driving control part permits driving of the assisting mechanism only if the recognized tension is within a permission range, which has a predetermined lower tension limit value and a predetermined upper tension limit value.

2. The assisting device control system according to claim 1, comprising:

a detection instruction part transmitting a signal instructing the sensor to detect the tension factor according to a detection request.

3. The assisting device control system according to claim 1, comprising:

a notification part which notifies; and a first notification instruction part enabling the notification part to notify that the tension is within the permission range if the recognized tension is within the permission range before driving of the assisting mechanism is started.

4. The assisting device control system according to claim 2, comprising:

a notification part which notifies; and a first notification instruction part enabling the notification part to notify that the tension is within the permission range if the recognized tension is within the permission range before driving of the assisting mechanism is started.

5. The assisting device control system according to claim 1, comprising:

a notification part which notifies; and a second notification instruction part enabling the notification part to notify that the tension is not within the permission range if the recognized tension is not within the permission range after driving of the assisting device is started.

6. The assisting device control system according to claim 2, comprising:

a notification part which notifies; and a second notification instruction part enabling the notification part to notify that the tension is not within the permission range if the recognized tension is not within the permission range after driving of the assisting device is started.

7. The assisting device control system according to claim 3, comprising:

a notification part which notifies; and a second notification instruction part enabling the notification part to notify that the tension is not within the permission range if the recognized tension is not within the permission range after driving of the assisting device is started.

8. The assisting device control system according to claim 1, wherein the driving control part stops driving of the assisting mechanism if the recognized tension is not within the permission range after driving of the assisting device is started.

9. The assisting device control system according to claim 2, wherein the driving control part stops driving of the assisting mechanism if the recognized tension is not within the permission range after driving of the assisting device is started.

10. The assisting device control system according to claim 3, wherein the driving control part stops driving of the assisting mechanism if the recognized tension is not within the permission range after driving of the assisting device is started.

11. The assisting device control system according to claim 5, wherein the driving control part stops driving of the assisting mechanism if the recognized tension is not within the permission range after driving of the assisting device is started.

12. A driving permission range deciding method deciding a permission range in an assisting device control system, which controls an assisting device and comprises:

a tension recognition part recognizing a tension when a brace is worn on a predetermined portion of a body of a wearer;

a driving control part permitting driving of an assisting mechanism, which moves the brace to apply an assisting force corresponding to movement of the wearer to the body of the wearer, only if the recognized tension is within the permission range that has a predetermined lower tension limit value and a predetermined upper tension limit value; and a range deciding part deciding the pelf fission range, wherein the assisting device comprises the brace and the assisting mechanism, and the assisting device control system comprises a data storage part storing tensions recognized during previous uses of the assisting device or assisting equipment corresponding to the assisting device, the driving permission range deciding method comprising:

a step that the range deciding part decides a permission range for a current use based on the tensions recognized during the previous uses.

13. The driving permission range deciding method according to claim 12, wherein the assisting device control system comprises a wearer attribute recognition part recognizing a wearer attribute, which is an attribute of a current wearer who is the wearer wearing the assisting device in current use, the data storage part associates and stores a wearer attribute of a past wearer who is the wearer wearing the assisting device or the assisting equipment corresponding to the assisting device during the previous uses, and the tensions recognized during the previous uses, and the driving permission range deciding method comprises a step that the range deciding part decides the permission range based on the wearer attribute of the current wearer and the tension associated with the wearer attribute of the past wearer corresponding to the wearer attribute.

14. The driving permission range deciding method according to claim 12, wherein the data storage part stores a setter attribute, which is an attribute of a setter, together with tensions set by the setter during the previous uses, and the driving permission range deciding method comprises a step that the range deciding part decides the permission range based on the tension set by the setter having a predetermined setter attribute among the tensions set during the previous uses.

15. The driving permission range deciding method according to claim 12, wherein the tensions recognized during the previous uses are tensions that are recognized when the wearer of the previous uses perfoinis predetermined movement for a predetermined period after application of the assisting force is started at a time of start of the previous uses.

16. The driving permission range deciding method according to claim 13, wherein the tensions recognized during the previous uses are tensions that are recognized when the wearer of the previous uses performs predetermined movement for a predetennined period after application of the assisting force is started at a time of start of the previous uses.

17. The driving permission range deciding method according to claim 14, wherein the tensions recognized during the previous uses are tensions that are recognized when the wearer of the previous uses performs predetermined movement for a predeteiiiiined period after application of the assisting force is started at a time of start of the previous uses.

18. The driving permission range deciding method according to claim 12, wherein the assisting device control system comprises an environment recognition part recognizing a surrounding environment which is an environment of a space where the wearer exists, and the driving permission range deciding method comprises a step that the range deciding part decides the permission range based on the tensions recognized during the previous uses and the surrounding environment for the current use.

19. The driving permission range deciding method according to claim 13, wherein the assisting device control system comprises an environment recognition part recognizing a surrounding environment which is an environment of a space where the wearer exists, and the driving peinlission range deciding method comprises a step that the range deciding part decides the permission range based on the tensions recognized during the previous uses and the surrounding environment for the current use.

20. The driving permission range deciding method according to claim 14, wherein the assisting device control system comprises an environment recognition part recognizing a surrounding environment which is an environment of a space where the wearer exists, and the driving permission range deciding method comprises a step that the range deciding part decides the permission range based on the tensions recognized during the previous uses and the surrounding environment for the current use.

* * * * *